US010972840B2

(12) United States Patent
Chen et al.

(10) Patent No.: US 10,972,840 B2
(45) Date of Patent: Apr. 6, 2021

(54) SPEAKER

(71) Applicant: MERRY ELECTRONICS (SHENZHEN) CO., LTD., Guangdong (CN)

(72) Inventors: Jen-Yi Chen, Taichung (TW); Yueh-Kang Lee, Taichung (TW); Kai-Yu Jiang, Taichung (TW); Chao-Sen Chang, Taichung (TW)

(73) Assignee: MERRY ELECTRONICS (SHENZHEN) CO., LTD., Guangdong (CN)

( * ) Notice: Subject to any disclaimer, the term of this patent is extended or adjusted under 35 U.S.C. 154(b) by 36 days.

(21) Appl. No.: 16/452,546

(22) Filed: Jun. 26, 2019

(65) Prior Publication Data

US 2020/0177996 A1 Jun. 4, 2020

(30) Foreign Application Priority Data

Nov. 30, 2018 (TW) ..... 107143127

(51) Int. Cl.

| | |
|---|---|
| ***H04R 25/00*** | (2006.01) |
| ***H04R 7/04*** | (2006.01) |
| ***H04R 1/02*** | (2006.01) |
| ***H04R 7/16*** | (2006.01) |
| ***H04R 17/10*** | (2006.01) |

(52) U.S. Cl.

CPC ..... *H04R 7/04* (2013.01); *H04R 1/025* (2013.01); *H04R 7/16* (2013.01); *H04R 17/10* (2013.01)

(58) Field of Classification Search

CPC ..... H04R 17/00; H04R 17/10
USPC ..... 381/190
See application file for complete search history.

(56) References Cited

U.S. PATENT DOCUMENTS

2011/0038495 A1* 2/2011 Jeong ..... H04R 17/00 381/190
2015/0082884 A1* 3/2015 Lim ..... H01L 41/0973 73/504.12
2020/0059734 A1* 2/2020 Chen ..... H04R 17/005

FOREIGN PATENT DOCUMENTS

WO WO-2016172866 A1 * 11/2016 ..... H04R 17/00
WO WO-2017055012 A1 * 4/2017 ..... H04R 3/00

* cited by examiner

*Primary Examiner* — Phylesha Dabney
(74) *Attorney, Agent, or Firm* — CKC & Partners Co., LLC

(57) ABSTRACT

A speaker includes a circuit board, a peripheral wall, a diaphragm, at least one support member and at least one piezoelectric actuator. The peripheral wall is located on a surface of the circuit board. The diaphragm has an outer boundary attached to the peripheral wall. The diaphragm, the peripheral wall and the circuit board collectively form a chamber. The at least one support member protrudes from the surface of the circuit board and is located within the chamber. The at least one piezoelectric actuator is located on a top of the at least one support member and electrically driven to cause a vibration of the diaphragm under applied electrical bias.

18 Claims, 15 Drawing Sheets

SPEAKER

CROSS-REFERENCE TO RELATED APPLICATION

This application claims priority to Taiwan Application Serial Number 107143127, filed Nov. 30, 2018 which is herein incorporated by reference.

BACKGROUND

Field of Invention

The present disclosure relates to a speaker, and more particularly, to a speaker equipped with a piezoelectric actuator.

Description of Related Art

Listening to music has become an indispensable part of modern life to regulate tension and monotony. Therefore, the sound quality of music produced by the speakers (such as speakers, headphones, etc.) of general consumer products and the experience of using the speaker to listening to music will affect consumption. As consumer demands for sound quality are also higher and higher, the requirements for speakers of general consumer products are increasingly taken care so as to improve the sound quality and the consumer experience.

Speakers include a variety of different sizes to satisfy with actual demands. Conventional speakers are designed with an electromagnetic mechanism as the sound-producing structure. However, the electromagnetic mechanism needs various necessary components that are usually more volumetric and energy consuming. How to output high sound quality in a small, low-power speaker is one of the product trends developed by speaker manufacturers.

SUMMARY

In one or more embodiments, a speaker includes a circuit board, a peripheral wall, a diaphragm, at least one support member and at least one piezoelectric actuator. The peripheral wall is located on a surface of the circuit board. The diaphragm has an outer boundary attached to the peripheral wall. The diaphragm, the peripheral wall and the circuit board collectively form a chamber. The at least one support member protrudes from the surface of the circuit board and is located within the chamber. The at least one piezoelectric actuator is located on a top of the at least one support member and electrically driven to cause a vibration of the diaphragm under applied electrical bias.

In one or more embodiments, the circuit board and the support member includes multiple conductive paths through which the piezoelectric actuator is connected to an external circuit.

In one or more embodiments, the speaker further includes an interconnection member coupled between the diaphragm and the piezoelectric actuator, wherein the piezoelectric actuator causes the vibration of the diaphragm by means of the interconnection member.

In one or more embodiments, the interconnection member includes a ring-shaped structure arranged around an outer edge of the piezoelectric actuator.

In one or more embodiments, the at least one support member is positioned at a central region of the chamber.

In one or more embodiments, the at least one support member comprise multiple support members that are spaced from one another within the chamber.

In one or more embodiments, the speaker further includes an interconnection member coupled between the diaphragm and the piezoelectric actuator, and the interconnection member is a H-shaped structure.

In one or more embodiments, the piezoelectric actuator is located on a top of each of the multiple support members, and each piezoelectric actuator has an end portion coupled to a recessed portion of the H-shaped structure.

In one or more embodiments, the piezoelectric actuator has end portions attached to the multiple support members respectively.

In one or more embodiments, the multiple support members and the at least one piezoelectric actuator collectively form another chamber.

In one or more embodiments, the piezoelectric actuator includes a piezoelectric layer and two electrode layers sandwiching the piezoelectric layer.

In one or more embodiments, the piezoelectric actuator includes a bendable member that is deformed along with the piezoelectric actuator under applied electrical bias.

In one or more embodiments, the piezoelectric actuator includes an arc-shaped member having a middle portion closer to a bottom of the chamber.

In one or more embodiments, the middle portion of the arc-shaped member is secured to a top of the at least one support member and away from the diaphragm, and the arc-shaped member further includes two opposite ends extending beyond two sidewalls of the at least one support member respectively and supporting the diaphragm.

In one or more embodiments, a speaker includes a circuit board, a peripheral wall, a diaphragm and at least one piezoelectric actuator. The peripheral wall is located on a surface of the circuit board. The diaphragm has an outer boundary attached to the peripheral wall. The diaphragm, the peripheral wall and the circuit board collectively form a chamber, wherein the diaphragm has at least one suspended edge. The least one piezoelectric actuator is located on the surface of the circuit board, and electrically driven to cause a vibration of the diaphragm under applied electrical bias. The stopper is located below the diaphragm and spaced from the at least one piezoelectric actuator.

In one or more embodiments, the speaker further includes an interconnection member coupled between the stopper and the at least one piezoelectric actuator, wherein the interconnection member or the stopper has a peripheral edge that is at least overlapped with the suspended edge of the diaphragm.

In one or more embodiments, the peripheral wall includes a protrusion located within the chamber.

In one or more embodiments, the protrusion of the peripheral wall is at least partially overlapped with the suspended edge of the diaphragm.

In one or more embodiments, the piezoelectric actuator includes an electrode plate that has an edge at least partially overlapped with the protrusion of the peripheral wall, the protrusion of the peripheral wall is configured to contact the electrode plate to set an upper stop position for the diaphragm when the diaphragm is pushed upwards.

In one or more embodiments, the piezoelectric actuator includes a bendable electrode plate, the stopper is configured to contact the bent electrode plate to set a lower stop position for the diaphragm when the diaphragm is pushed downwards.

In one or more embodiments, the piezoelectric actuator includes a piezoelectric layer, an upper electrode layer and a lower electrode layer, and the piezoelectric layer is sandwiched between the upper and lower electrode layers.

In one or more embodiments, the circuit board has two through holes, and the lower electrode layer is connected to the surface of the circuit board and located at a central region of the chamber that is between the two through holes.

In sum, the speaker disclosed herein utilizes different configurations of the piezoelectric actuators, circuit board and one or more support members to form different types of vibration chambers and/or diaphragm driving mechanisms, thereby enabling the speaker to output different qualities of sounds.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
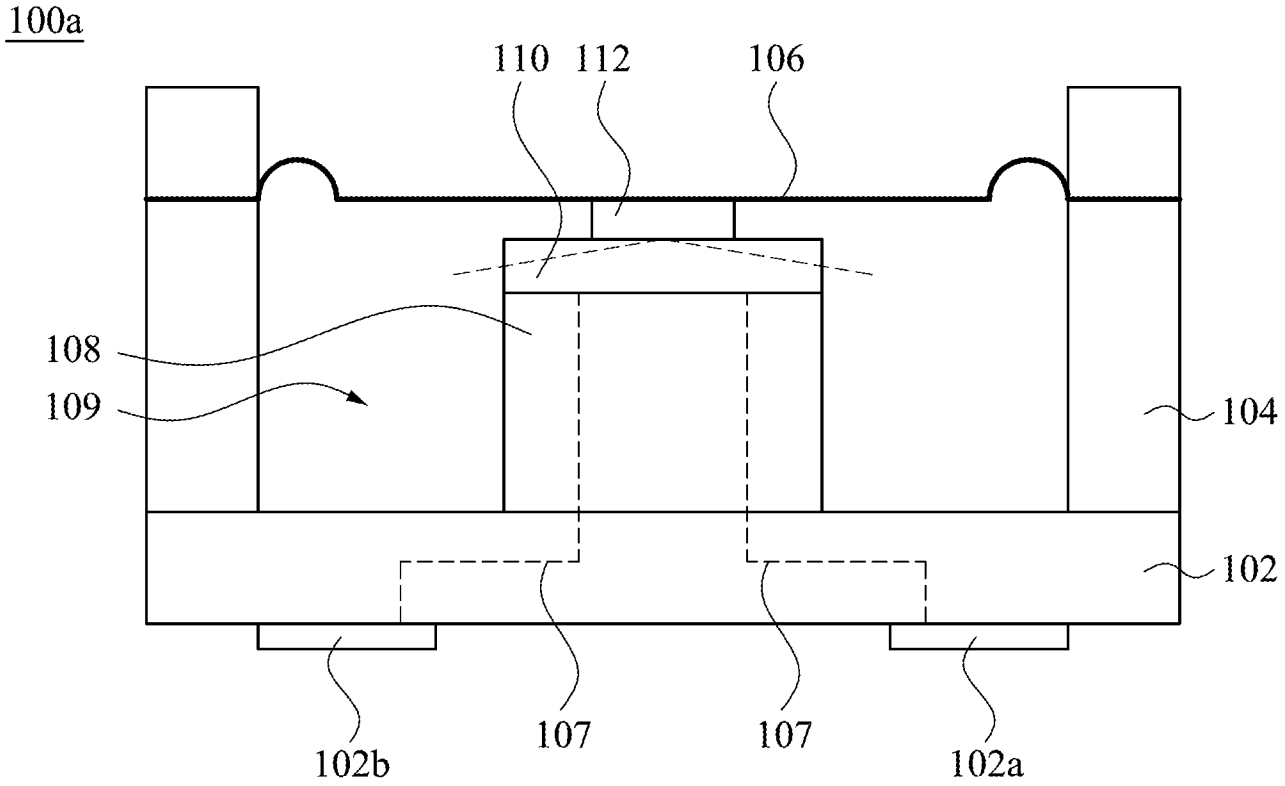
FIG. 1 illustrates a cross sectional view of a speaker according to one embodiment of the present disclosure.

Reference will now be made in detail to the present embodiments of the invention, examples of which are illustrated in the accompanying drawings. Wherever possible, the same reference numbers are used in the drawings and the description to refer to the same or like parts.

Figure 2:
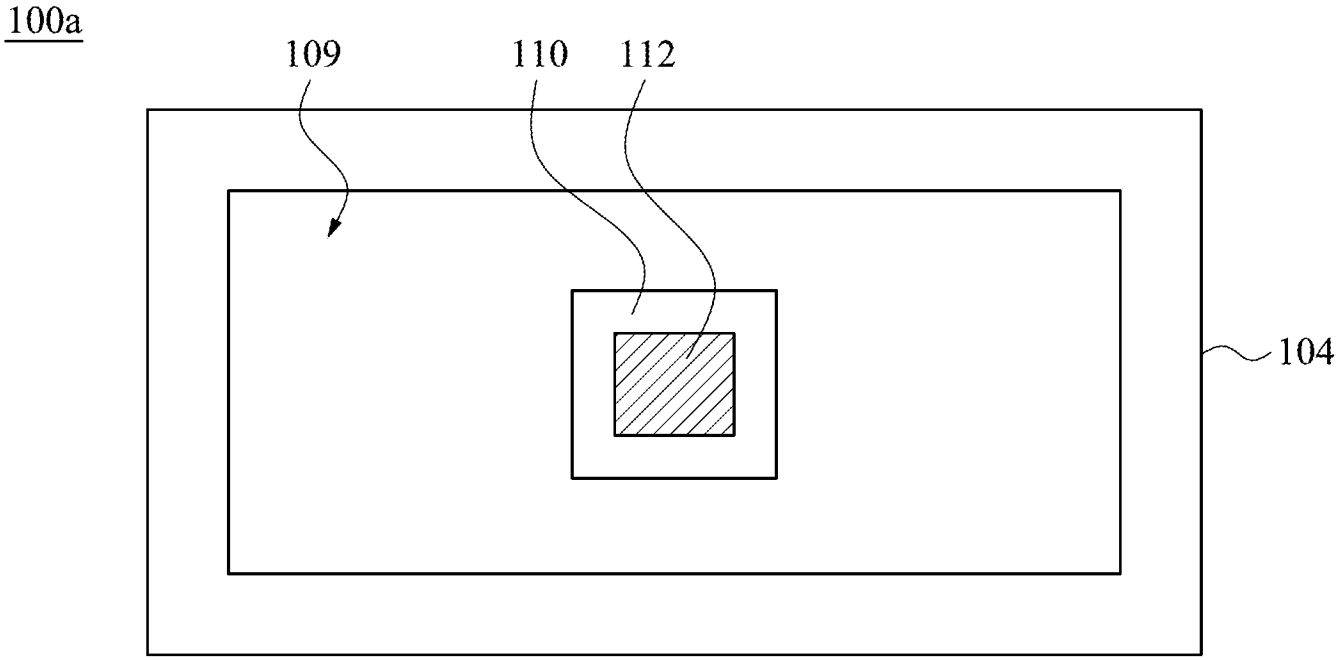
FIG. 2 illustrates a top view of the speaker in FIG. 1 with its diaphragm removed.

Reference is made to FIGS. 1 and 2. FIG. 1 illustrates a cross sectional view of a speaker according to one embodiment of the present disclosure, and FIG. 2 illustrates a top view of the speaker in FIG. 1 with its diaphragm removed. A speaker 100*a* includes a circuit board 102, a diaphragm 106, a support member 108, and a piezoelectric actuator 110. The speaker has a peripheral wall 104 on one surface of the circuit board 102. The peripheral wall 104 may be different from the circuit board 102 in materials or part of the circuit board 102, and it protrudes from the surface of the circuit board 102 and surrounds an outer edge of the circuit board 102. An outer boundary of the diaphragm 106 is attached to a top portion of the peripheral wall 104 to form a chamber 109 together with the circuit board 102 and its peripheral wall 104, i.e., the diaphragm 106, the peripheral wall 104 and the circuit board 102 collectively define the chamber 109. The support member 108 protrudes out from the surface of the circuit board 102 and is located within the chamber 109 such that a height of the support member 108 should be lower than a height of the peripheral wall 104. The piezoelectric actuator 110 is located on a top surface of the support member 108, and the piezoelectric actuator 110 is deformed (e.g., as the curved dashed line illustrated in FIG. 1) under applied electrical biases or voltages, thereby driving the diaphragm 106 to vibrate. Unlike the electromagnetic mechanism of a conventional speaker as the sound-producing structure, the speaker 100*a* has a simpler mechanism to control the deformation of the piezoelectric actuator 110, which can directly drive a vibration of the diaphragm 106.

In this embodiment, the speaker 100*a* may further include an interconnection member 112 coupled between the piezoelectric actuator 110 and the diaphragm 106, and the piezo actuator 110 is located between the support member 108 and the interconnection member 112. The piezoelectric actuator 110 may also be directly coupled to the diaphragm 106 without the interconnection member 112.

In this embodiment, a thickness of the support member 108 is greater than a thickness of the piezoelectric actuator 110, but is not limited thereto.

In this embodiment, the circuit board 102 and the support member 108 may include multiple conductive paths 107 through which the piezoelectric actuator 110 is connected to an external circuit to obtain an applied electrical biases or voltages.

In this embodiment, the peripheral wall 104 and the circuit board 102 may be made from the same materials, and may be simultaneously formed, but no conductive path is required in the peripheral wall 104.

In this embodiment, the support member 108 is located in a central area of the chamber 109, e.g. a central area of the chamber 109 from a top view point, but not being limited thereto.

Figure 3:
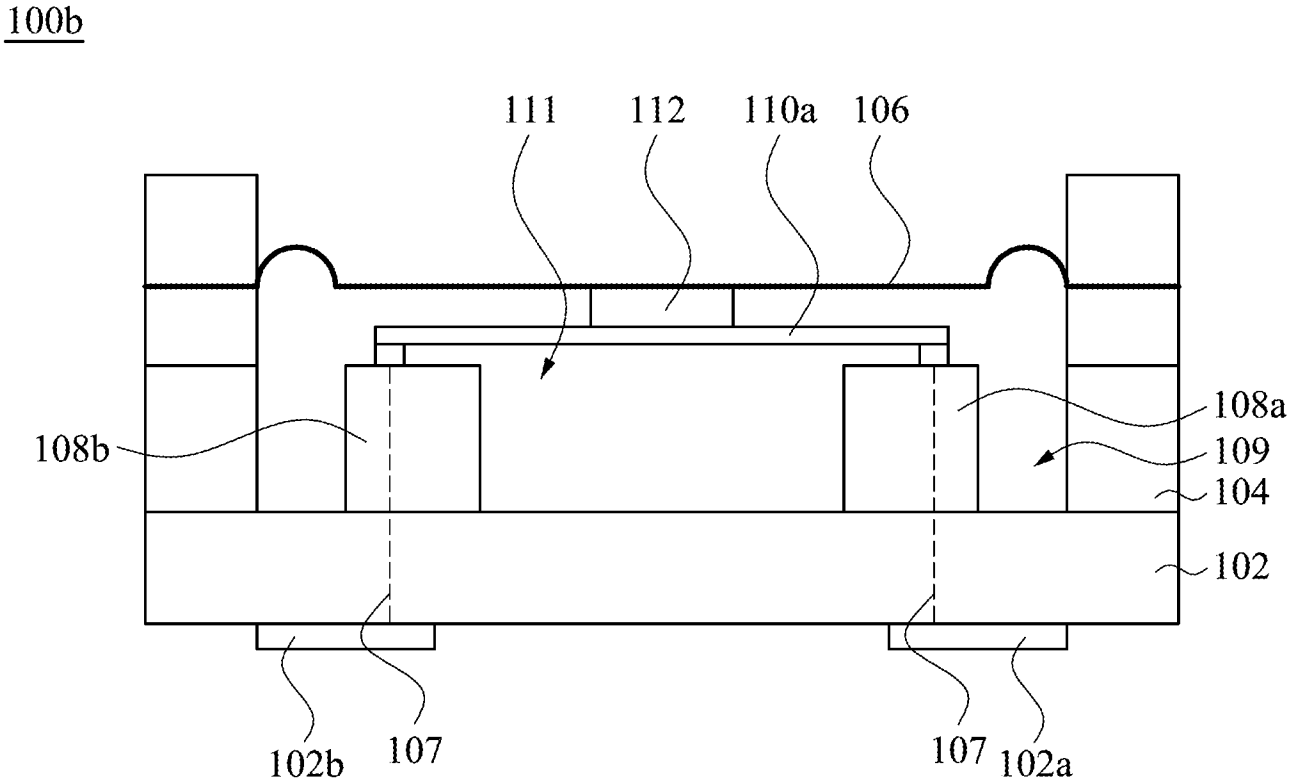
FIG. 3 illustrates a cross sectional view of a speaker according to another embodiment of the present disclosure.
Figure 4:
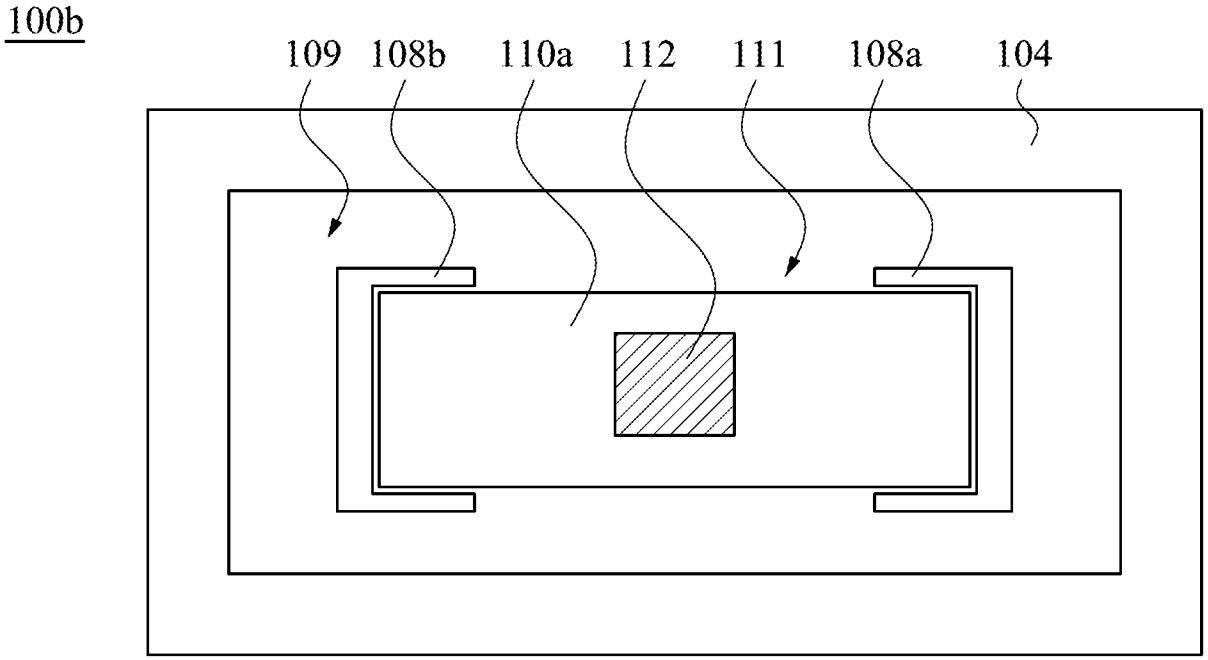
FIG. 4 illustrates a top view of the speaker in FIG. 3 with its diaphragm removed.

Reference is made to FIGS. 3 and 4. FIG. 3 illustrates a cross sectional view of a speaker according to another embodiment of the present disclosure, and FIG. 4 illustrates a top view of the speaker in FIG. 3 with its diaphragm removed.

A speaker 100*b* includes a circuit board 102, a diaphragm 106, two support members (108*a*, 108*b*), and a piezoelectric actuator 110*a*. The speaker 102 has a peripheral wall 104 on one surface of the circuit board 102, and the peripheral wall 104 protrudes from the surface of the circuit board 102 and surrounds an outer edge of the circuit board 102. An outer boundary of the diaphragm 106 is attached to a top portion of the peripheral wall 104 to form a chamber 109 together with the circuit board 102 and its peripheral wall 104, i.e., the diaphragm 106, the peripheral wall 104 and the circuit board 102 collectively define the chamber 109. The support member 108 protrudes from the surface of the circuit board 102 and is located within the chamber 109. Two ends or a periphery of the piezoelectric actuator 110*a* are located on the top surface of the support member 108, and the piezoelectric actuator 110 is deformed at an applied voltage to drive the diaphragm 106 to vibrate.

In this embodiment, the two support members (108*a*, 108*b*) are separately located in the chamber 109, but not limited thereto. For example, three or more support members can be separately located in the chamber 109 for securing the piezoelectric actuator(s) thereon.

In this embodiment, the two support members (108*a*, 108*b*) and the piezoelectric actuator 110*a* form another chamber 111 (e.g., an area between the two support members (108*a*, 108*b*)). The chamber 111 is a smaller space within the chamber 109, and the two chambers are fluid-communicated to each other. Compared to the speaker 100*a*, the speaker 100*b* can generate a different sound output by configuring multiple chambers to generate a resonance chamber different from the speaker 100*a*.

In this embodiment, the piezoelectric actuator 110*a* is powered from an external circuit through two electrodes (102*a*, 102*b*) and the conductive paths 107 in the circuit board 102 and the support members (108*a*, 108*b*) to apply the desired polarities, electrical biases or voltages.

Figure 5:
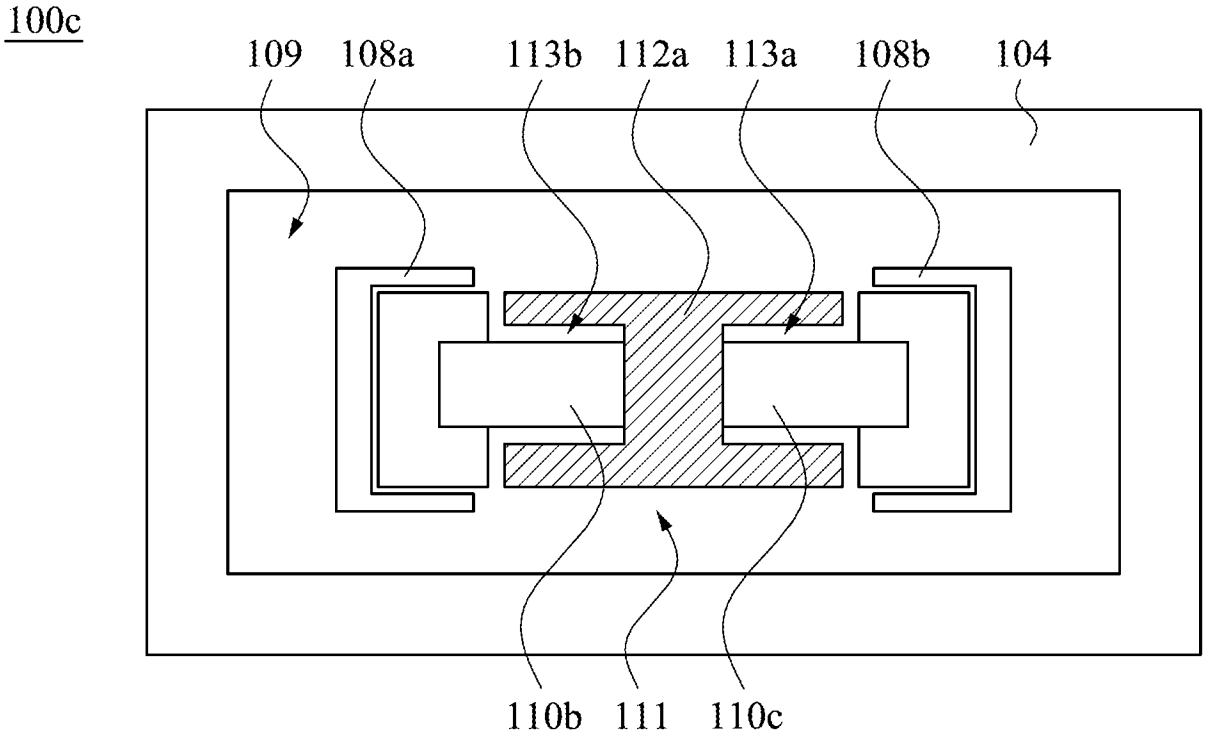
FIG. 5 illustrates a top view of the speaker with its diaphragm removed according to still another embodiment of the present disclosure.

FIG. 5 illustrates a top view of the speaker with its diaphragm removed according to still another embodiment of the present disclosure. In this embodiment, a speaker 100*c* includes a circuit board 102, a diaphragm 106, two support members (108*a*, 108*b*), and two piezoelectric actuators (110*b*, 110*c*). Compared with the speaker 100*b*, the speaker 100*c* is configured with more piezoelectric actuators, i.e., two actuators.

In this embodiment, the speaker 100*c* further includes an interconnection member 112*a* coupled between the piezoelectric actuators (110*b*, 110*c*) and the diaphragm, e.g., the diaphragm 106 of FIGS. 1 and 3, and the interconnection member 112*a* is an H-shaped structure. The two piezoelectric actuators (110*b*, 110*c*) are respectively connected to the recessed portions (113*a*, 113*b*) of two opposite ends of the H-shaped interconnecting member 112*a*, and the other ends of the two piezoelectric actuators (110*b*, 110*c*) are respectively connected to the tops of the two support members (108*a*, 108*b*). The speaker 100*c* has a configuration of two piezoelectric actuators and an H-shaped interconnection member, which can make its sound output different from the speaker 100*b*.

This embodiment exemplifies that two support members (108*a*, 108*b*) are respectively configured with two piezoelectric actuators (110*b*, 110*c*) which are connected to the diaphragm by an H-shaped interconnection member 112*a*. The two support members (108*a*, 108*b*), two piezoelectric actuators (110*b*, 110*c*) and the H-shaped interconnect member 112*a* collectively form another chamber space 111, which is a smaller space within the chamber 109, and the two chambers are fluid-communicated to each other. However, the present invention may also include three or more support members and include the same or different number of piezoelectric actuators, and then connected to the diaphragm with a desired shaped interconnection member, which may still modify the configuration of the multiple chambers, e.g., shapes, thereby tuning its sound output different from the aforementioned speakers.

Figure 6:
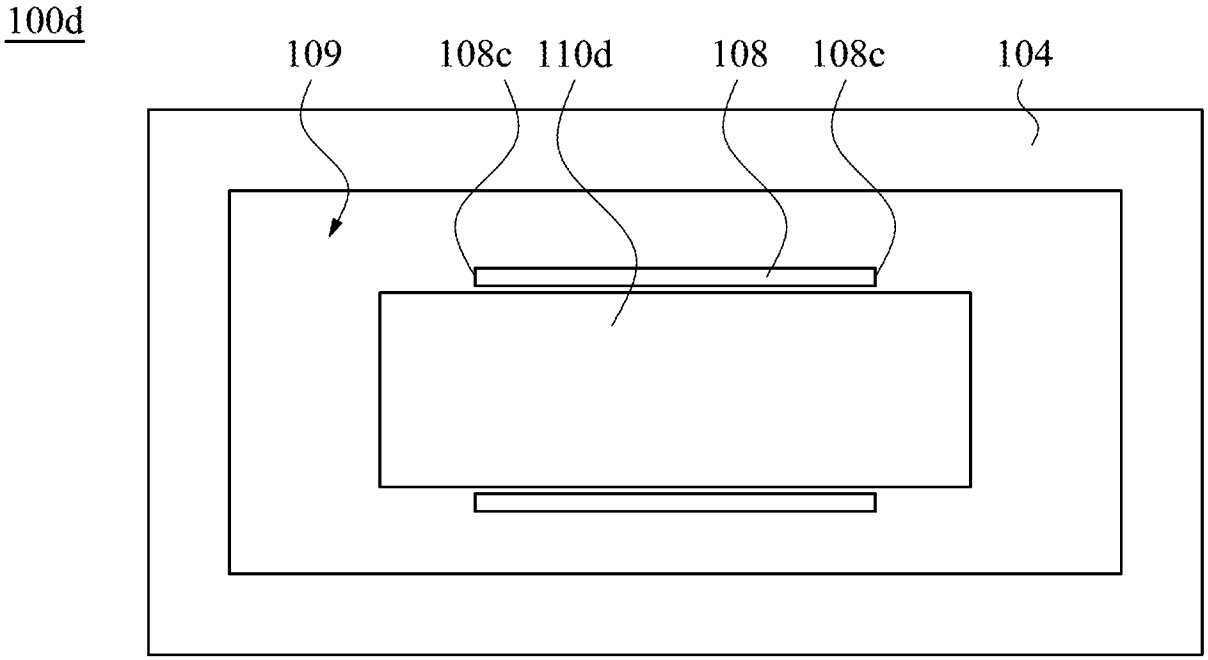
FIG. 6 illustrates a top view of the speaker with its diaphragm removed according to still another embodiment of the present disclosure.
Figure 7:
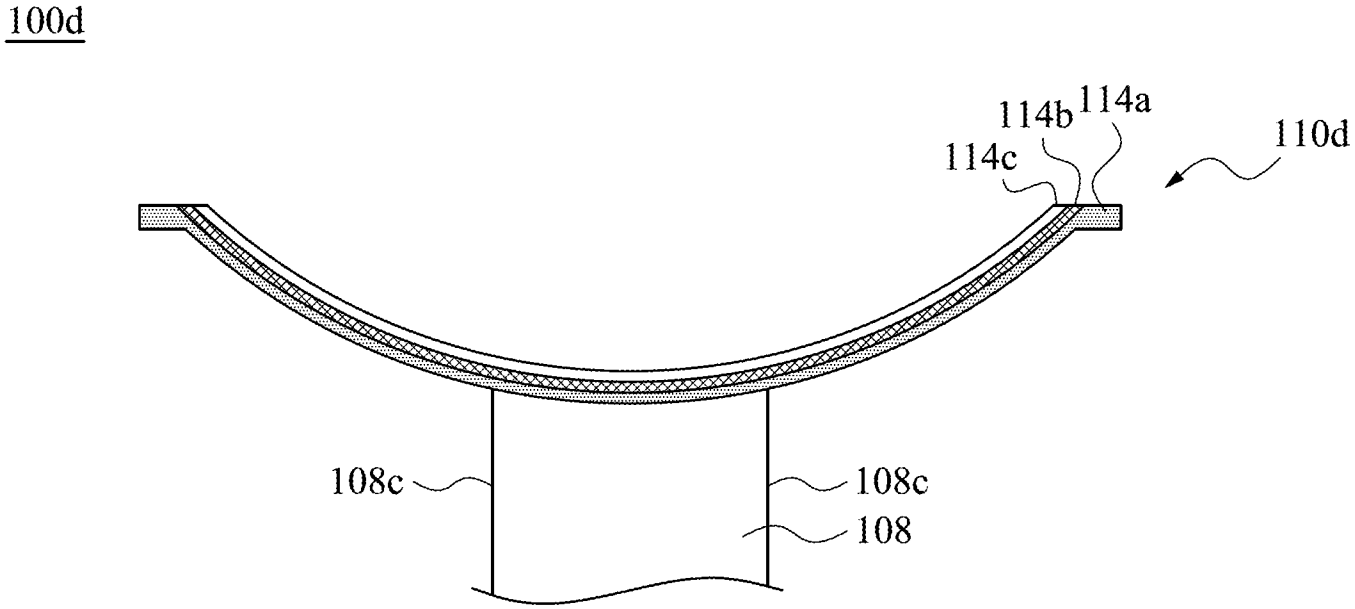
FIG. 7 illustrates a cross sectional view of a support member and a piezoelectric actuator of the speaker in FIG. 6.

Reference is made to FIGS. 6 and 7. FIG. 6 illustrates a top view of the speaker with its diaphragm removed according to still another embodiment of the present disclosure, and FIG. 7 illustrates a cross sectional view of a support member and a piezoelectric actuator of the speaker in FIG. 6. A speaker 100*d* includes a circuit board 102, a diaphragm 106, a support member 108, and a piezoelectric actuator 110*d*. The piezoelectric actuators 110*d* is an arc-shaped structure with a middle portion closer to the chamber (an initial shape without applying electrical biases or voltages), and the middle portion of the arc-shaped structure is secured to a top of the support member 108, and distant from a diaphragm, e.g., 106 in FIGS. 1 and 3. Two ends of the arc-shaped structure extend beyond two sidewalls 108*c* of the support member 108 respectively, and have their end top surfaces connected to a diaphragm, e.g., 106 in FIGS. 1 and 3. When the piezoelectric actuator 110*d* is applied with electrical biases or voltages, the diaphragm 106 is driven by the piezoelectric actuator 110*d* to generate sounds.

In this embodiment, the piezoelectric actuator 110*d* includes a piezoelectric layer 114*b* and two electrode layers (114*a*, 114*c*), and the two electrode layers (114*a*, 114*c*) sandwich the piezoelectric layer (114*b*). The two electrode layers 114*a* are electrically conductive flexible members, e.g., a sheet of stainless steel. This embodiment utilizes a ductile metal piece as an electrode for the piezoelectric actuator, which enables the piezoelectric actuator to have a larger deformation amount and a longer service life. The design of the piezoelectric actuator 110*d* containing sheet metal or stainless steel sheet may also be used as the piezoelectric actuators in the previously-discussed embodiments.

Figure 8:
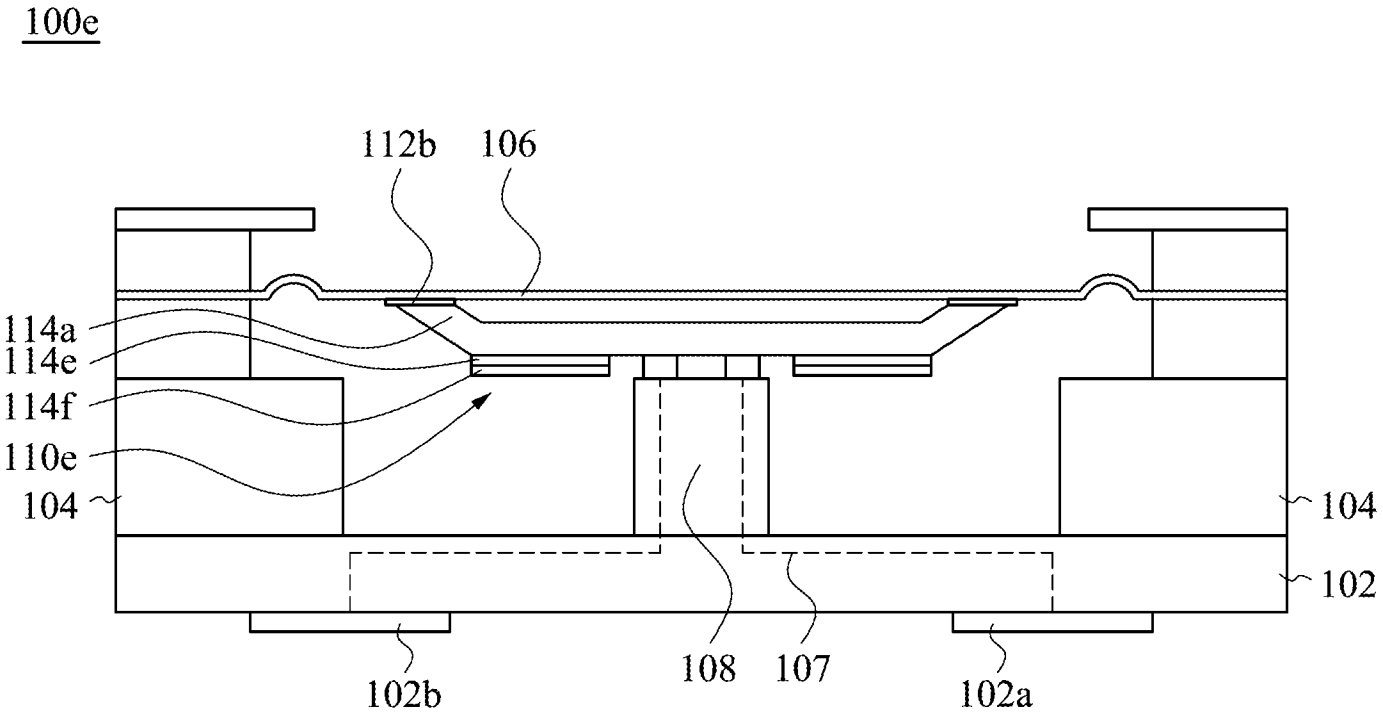
FIG. 8 illustrates a cross sectional view of a speaker according to still another embodiment of the present disclosure.
Figure 9:
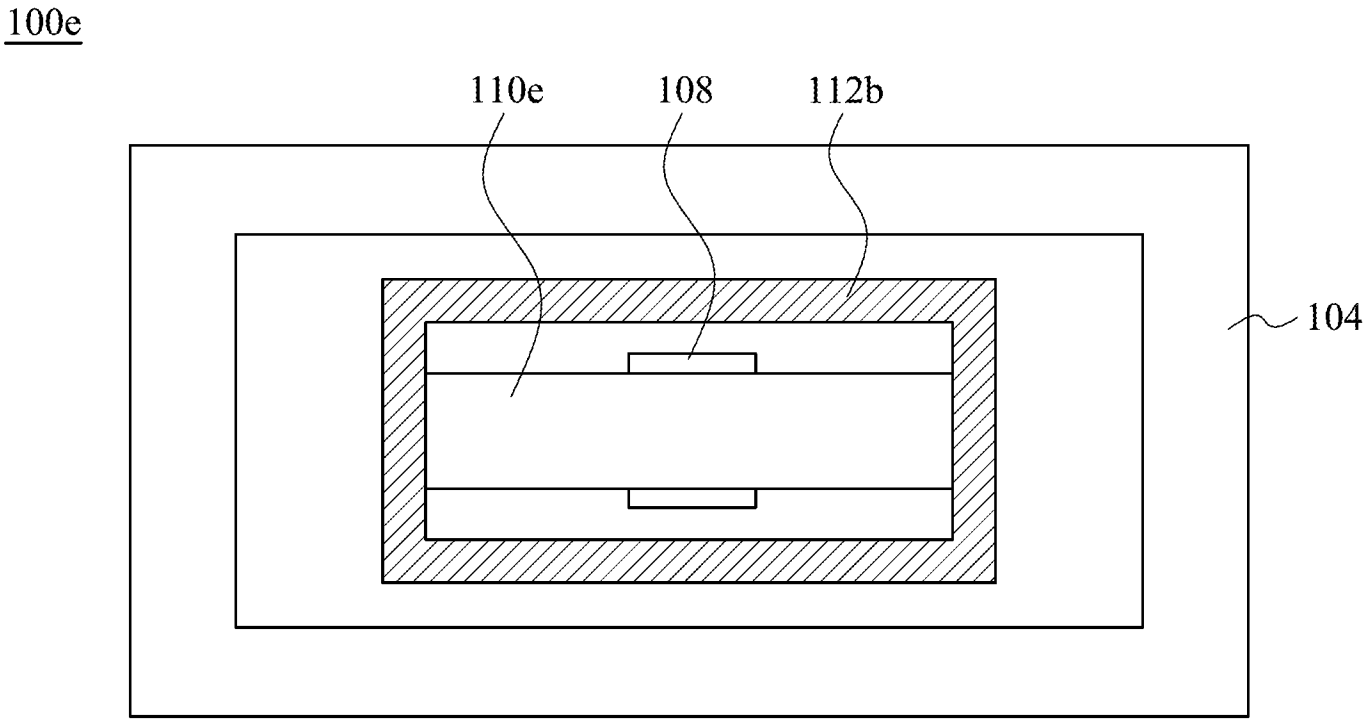
FIG. 9 illustrates a top view of the speaker in FIG. 8 with its diaphragm removed.

Reference is made to FIGS. 8 and 9. FIG. 8 illustrates a cross sectional view of a speaker according to still another embodiment of the present disclosure, and FIG. 9 illustrates a top view of the speaker in FIG. 8 with its diaphragm removed. A speaker 100*e* includes a circuit board 102, a diaphragm 106, a support member 108, and a piezoelectric actuator 110*e*. An outer boundary of the diaphragm 106 is attached to a top portion of the peripheral wall 104 to form a chamber with the circuit board 102 and its peripheral wall 104, i.e., the diaphragm 106, the peripheral wall 104 and the circuit board 102 collectively define the chamber. The piezoelectric actuator 110*e* includes an electrode layer 114*a*, a piezoelectric layer 114*e*, and an electrode layer 114*f*. The piezoelectric layer 114*e* is sandwiched between the electrode layer 114*a* and the electrode layer 114*f*. The electrode layer 114*a* of the piezoelectric actuator 110*e* is an arc-shaped structure with its middle portion closer to a bottom of the chamber and secured to the support member 108 to avoid interference between the piezoelectric actuator and the diaphragm 106 when the diaphragm 106 vibrates. The electrode layer 114*a* may be a metal sheet (for example, a stainless steel sheet). The piezoelectric actuator 110*e* is powered from an external circuit of the speaker through two electrodes (102*a*, 102*b*) and the conductive paths 107 in the circuit board 102 and the support member 108 to apply the desired polarities, electrical biases or voltages. The electrode layer 114*a* is a conductive flexible member that can be deformed under stress, and the flexible member is deformed along with the piezoelectric actuator 110*e* under the applied voltage, thereby causing the piezoelectric actuator 110*e* to swing up and down to cause the vibration of the diaphragm 106. The piezoelectric actuator 110*e* is different from the piezoelectric actuator 110*d* at least in that two piezoelectric layers 114*e* are discontinuously located on two opposite sides of the support member 108, unlike the piezoelectric layer 114*b* distributed continuously in the piezoelectric actuator.

In this embodiment, the piezoelectric actuator 110*e* has its middle portion coupled to a top of the support member 108 and two opposite ends extending beyond two sidewalls of the support member 108 and coupled to an interconnection member 112*b* by its outer edges. The diaphragm 106 is coupled and supported by the ring-shaped interconnect member 112*b* to increase the stability of the vibration, but not limited thereto. In addition, the ring-shaped interconnection member 112*b* is arranged around on a periphery or an outer edge of the piezoelectric actuator 110*e*, but is not limited thereto.

Figure 10:
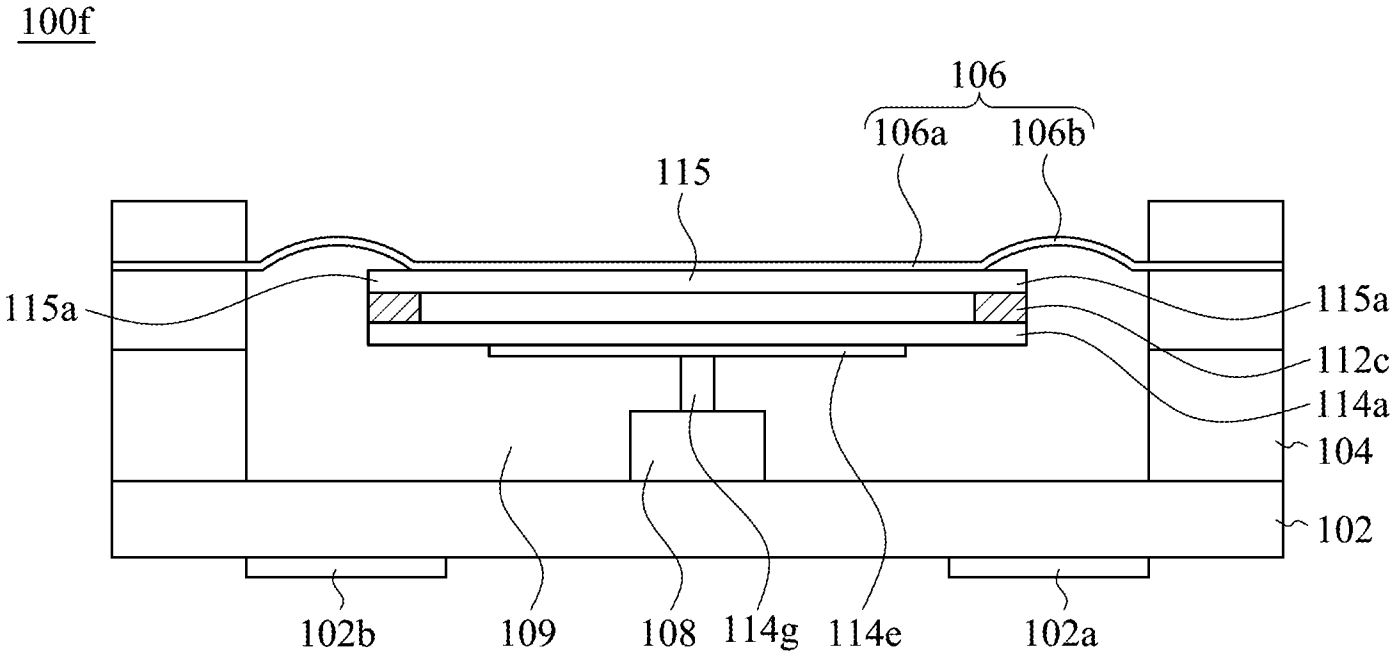
FIG. 10 illustrates a cross sectional view of a speaker according to still another embodiment of the present disclosure.
Figure 11:
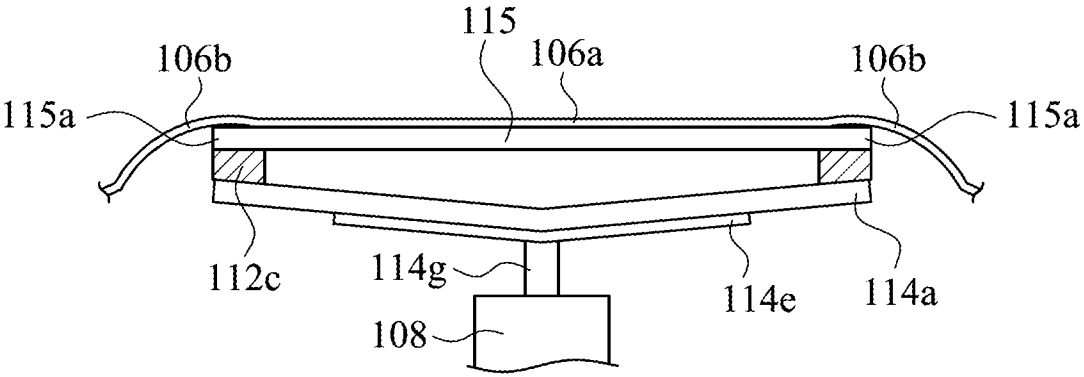
FIGS. 11 and 12 illustrate two operation modes of the speaker in FIG. 10.
Figure 12:
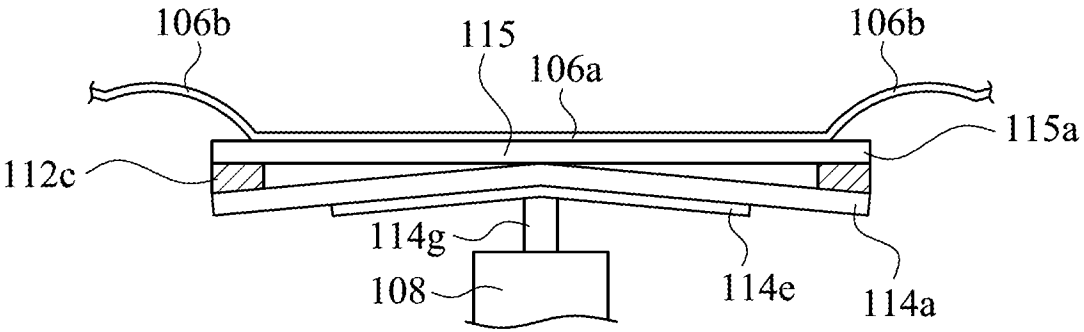

Reference is made to FIGS. 10-12. FIG. 10 illustrates a cross sectional view of a speaker according to still another embodiment of the present disclosure; and FIGS. 11 and 12 illustrate two operation modes of the speaker in FIG. 10. A speaker 100*f* includes a circuit board 102, a diaphragm 106, a support member 108, and a piezoelectric actuator. The diaphragm 106 includes a central flat portion 106*a* and a suspended edge 106*b* surrounding the central flat portion 106*a*. The suspended edge 106*b* may be an arc-shaped portion when the diaphragm 106 is not driven to vibrate, but is not limited thereto. The piezoelectric actuator includes an upper electrode layer 114*a*, a piezoelectric layer 114*e*, and a lower electrode layer 114*g*. The piezoelectric layer 114*e* is sandwiched between the electrode layer 114*a* and the electrode layer 114*g*. The electrode layer 114*a* may be a metal sheet (for example, a stainless steel sheet). When the piezoelectric actuator is applied with electrical biases or voltages, the diaphragm 106 is driven by the piezoelectric actuator to generate sounds.

In this embodiment, the speaker 100*f* further includes a stopper 115 to restrict the diaphragm 106 vibrating within a position range. The stopper 115 is attached below the diaphragm 106 (or an inner side of the diaphragm 106) and its outer peripheral edge 115*a* is at least vertically overlapped with the suspended edge 106*b* of the diaphragm 106. An interconnection member 112*c* is coupled between the stopper 115 and the electrode layer 114*a* at the peripheral portions. The interconnection member 112*c* may be made from an electrically-insulated elastic material such that the stopper 115 can be electrically-insulated from the electrode layer 114*a*. When the diaphragm 106 is pushed upwards by an unexpected pressure or inertial force (see FIG. 11), the outer peripheral edge 115*a* of the stopper 115 will contact the deformed suspended edge 106*b* of the diaphragm 106, thereby setting an upper stop position for the diaphragm 106. When the diaphragm 106 is pushed downwards by an unexpected pressure or inertial force (see FIG. 12), a middle or central portion of the stopper 115 will contact the bent electrode layer 114*a*, thereby setting a lower stop position for the diaphragm 106. The stopper 115 may be a rigid metal plate, e.g., more rigid than the electrode layer 114*a*, with a thickness ranging from about 10 μm to about 15 μm.

Figure 13:
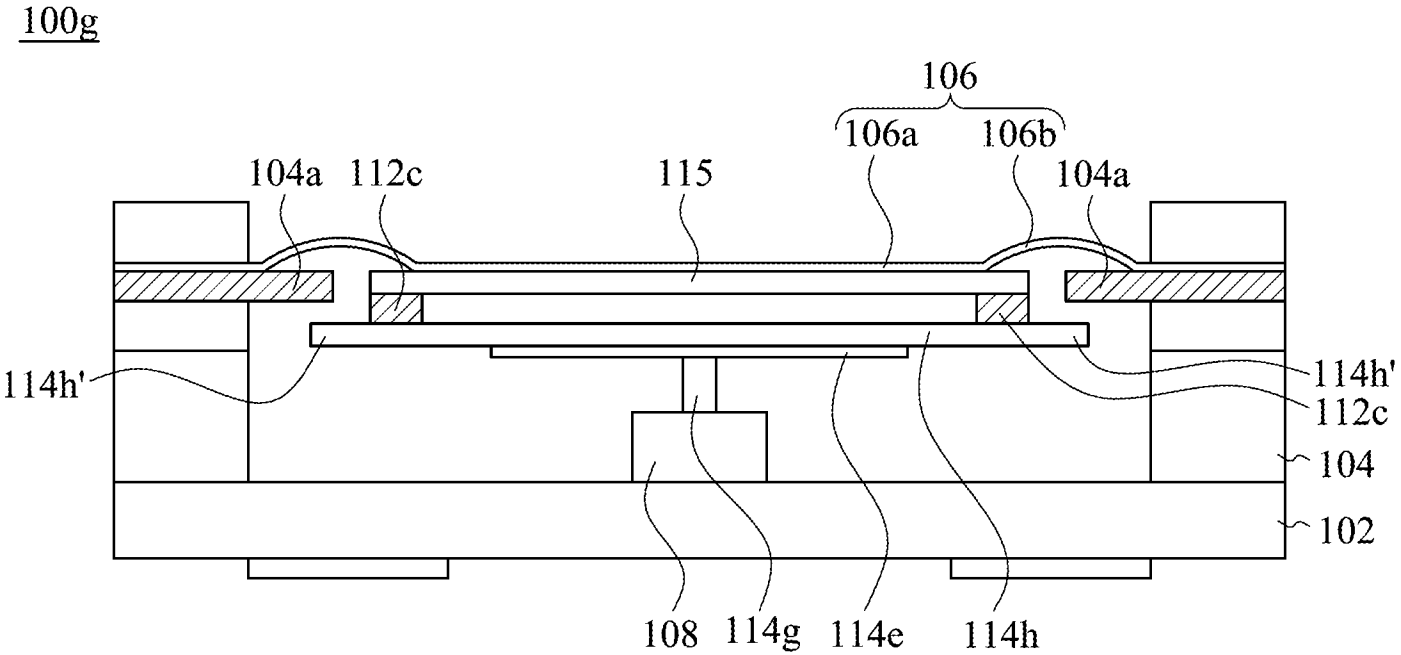
FIG. 13 illustrates a cross sectional view of a speaker according to still another embodiment of the present disclosure.
Figure 14:
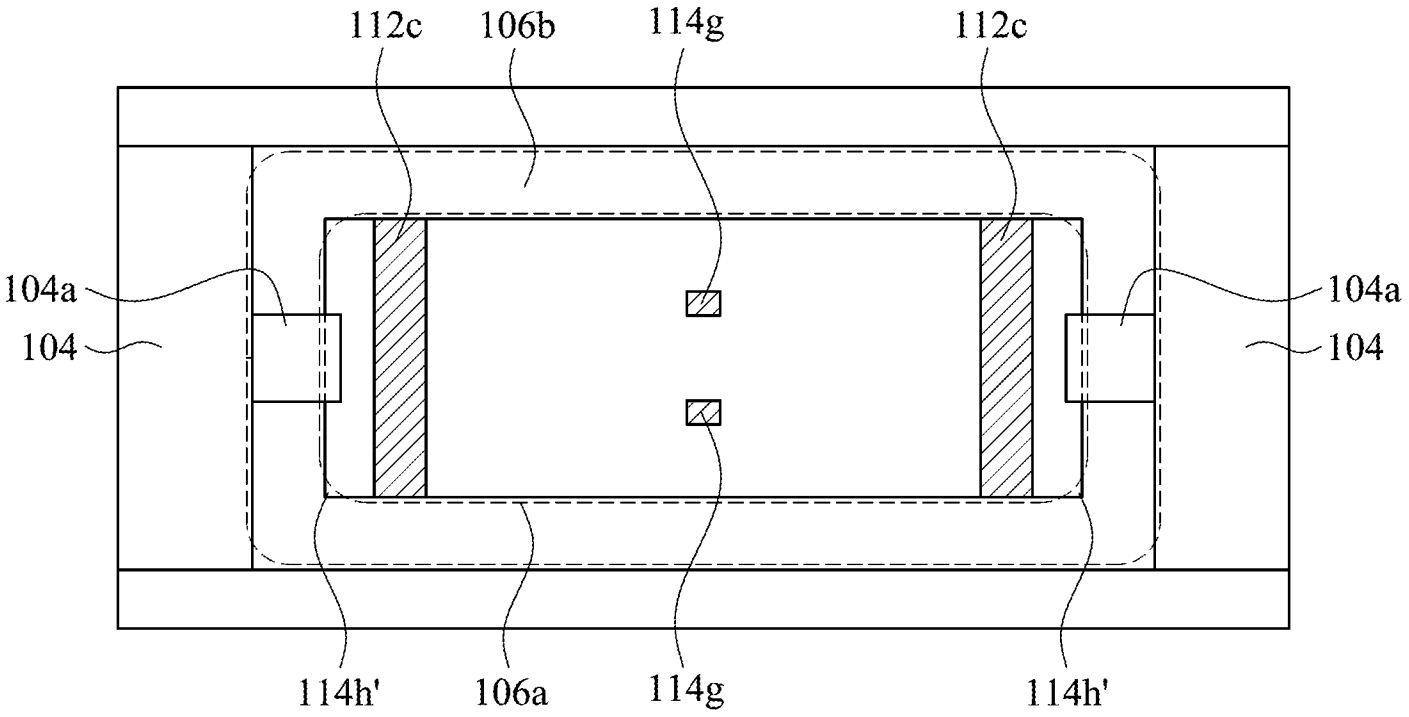
FIG. 14 illustrates a top view of the speaker in FIG. 13.
Figure 15:
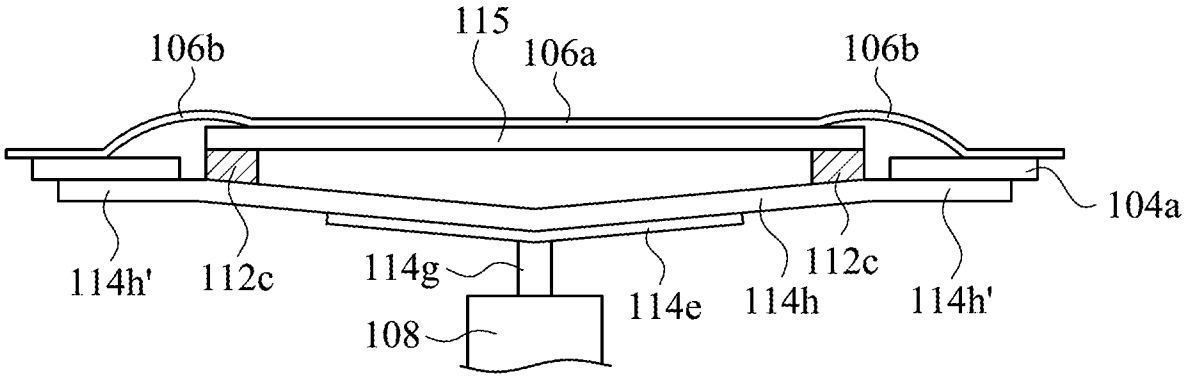
FIGS. 15 and 16 illustrate two operation modes of the speaker in FIG. 13.
Figure 16:
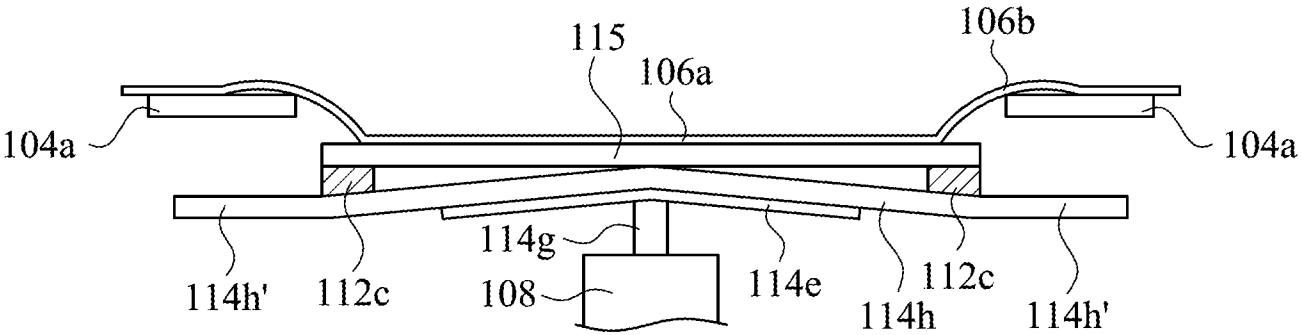

Reference is made to FIGS. 13-16. FIG. 13 illustrates a cross sectional view of a speaker 100*g* according to still another embodiment of the present disclosure; FIG. 14 illustrates a top view of the speaker in FIG. 13; and FIGS. 15 and 16 illustrate two operation modes of the speaker in FIG. 13. The speaker 100*g* is different from the speaker 100*f* mainly in the restriction mechanism for the diaphragm 106.

In this embodiment, the peripheral wall 104 has a protrusion 104*a* located within the chamber 109, and the protrusion 104*a* is at least partially overlapped with the suspended edge 106*b* of the diaphragm 106. In addition, the piezoelectric actuator has an electrode plate 114*h*, which has its edge 114*h*' at least partially overlapped with the protrusion 104*a* of the peripheral wall 104.

In this embodiment, the interconnection member 112*c* includes two parallel strip members, and each strip member is at least partially overlapped with the suspended edge 106*b* of the diaphragm 106, and the two parallel strip members are symmetrical to each other relative to the support member 108.

When the diaphragm 106 is pushed upwards by an unexpected pressure or inertial force (see FIG. 15), the edge 114*h*' of the electrode plate 114*h* will contact the deformed suspended edge 106*b* of the diaphragm 106, thereby setting an upper stop position for the diaphragm 106. When the diaphragm 106 is pushed downwards by an unexpected pressure or inertial force (see FIG. 16), a middle or central portion of the stopper 115 will contact the bent electrode plate 114*h*, thereby setting a lower stop position for the diaphragm 106. In this embodiment, the displacement amount of the diaphragm 106 during the vibration process is reduced due to the stopper 115, so as to prevent the diaphragm 106 from colliding with other structures due to excessive vibration when receiving a high impact or a large sound pressure, thereby improving the reliability of the speaker.

In other embodiments, the support member 108 may be omitted in one or more of the previous embodiments, e.g. the support member 108 in FIG. 13 is omitted, and a thicker electrode layer 114*g* is connected between the piezoelectric layer 114*e* and the circuit board 102*g*.

Figure 17:
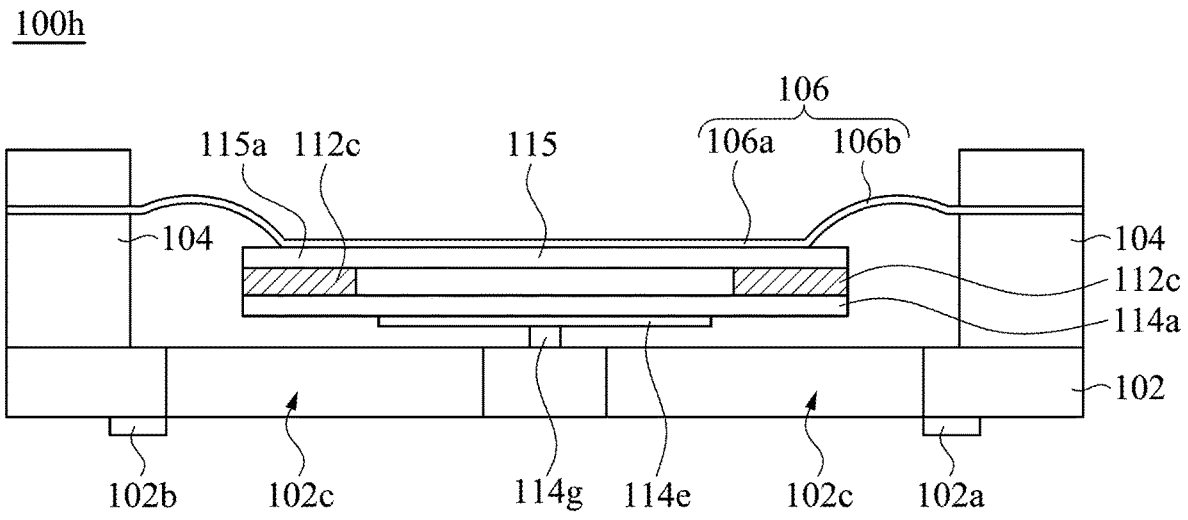
FIG. 17 illustrates a cross sectional view of a speaker according to still another embodiment of the present disclosure.
Figure 18:
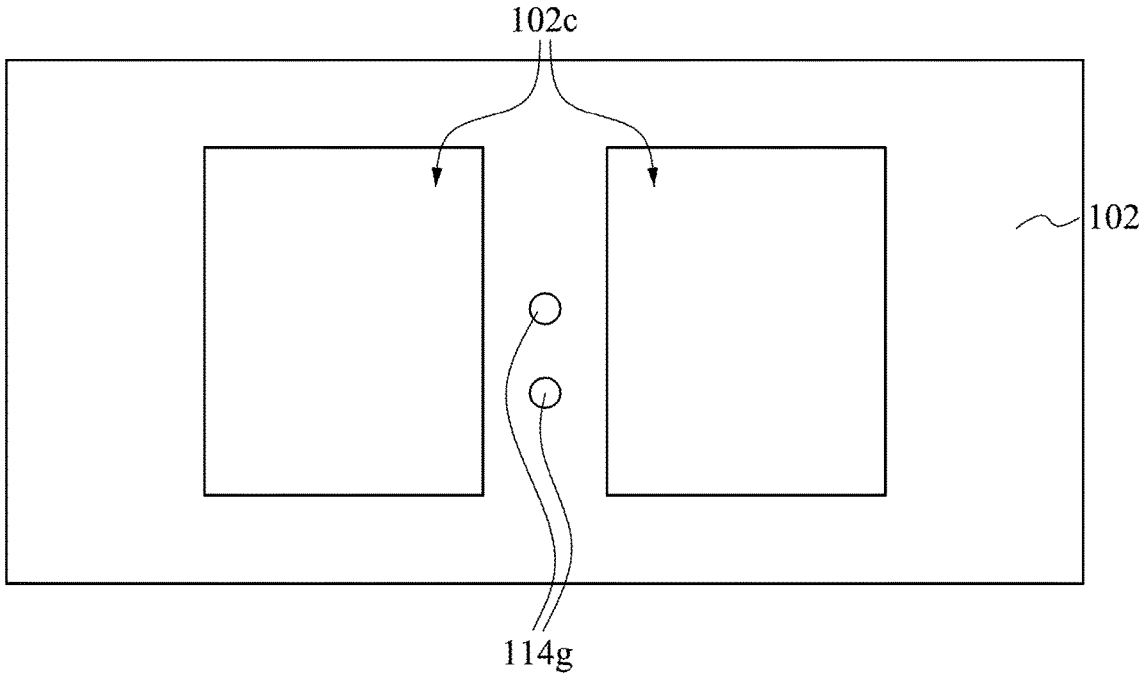
FIG. 18 illustrates a top view of the circuit board in FIG. 17.

Reference is made to FIGS. 17-18. FIG. 17 illustrates a cross sectional view of a speaker according to still another embodiment of the present disclosure, and FIG. 18 illustrates a top view of the circuit board in FIG. 17. The speaker 100*h* is different from the speaker 100*f* mainly in a different design of the circuit board 100.

In this embodiment, the support member 108 is absent on the circuit board 102, and a thicker electrode layer 114*g* on the circuit board 102 is configured to connect and support the piezoelectric layer 114*e*, thereby reducing the manufacturing difficulty and cost for the circuit board 102. In addition, the circuit board 102 excavates two through holes 102*c* in order to provide a back cavity required for vibrating the speaker, and does not need an additional support member to increase space for back cavity. Therefore, the back cavity can be achieved by attaching a gas permeable film at the bottom of the speaker 100*h* or mounting the speaker 100*h* on a system board.

In this embodiment, the electrode layer 114*g* is connected to the surface of the circuit board 102 and located at a central region of the chamber, which is between the two through holes 102*c*.

In sum, the speaker disclosed herein utilizes different configurations of the piezoelectric actuators, circuit board and one or more support members to form different types of vibration chambers and/or diaphragm driving mechanisms, thereby enabling the speaker to output different quality of sounds.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A speaker comprising:

a circuit board;

a peripheral wall disposed on a surface of the circuit board;

a diaphragm having an outer boundary attached to the peripheral wall, and the diaphragm, the peripheral wall and the circuit board collectively form a chamber;

at least one support member protruding from the surface of the circuit board and disposed within the chamber; and at least one piezoelectric actuator disposed on a top of the at least one support member and electrically driven to cause a vibration of the diaphragm under applied electrical bias, wherein the circuit board and the support member comprise multiple conductive paths through which the piezoelectric actuator is connected to an external circuit.

2. The speaker of claim 1 further comprising an interconnection member coupled between the diaphragm and the piezoelectric actuator, wherein the piezoelectric actuator causes the vibration of the diaphragm by means of the interconnection member.

3. The speaker of claim 2, wherein the interconnection member comprises a ring-shaped structure disposed around an outer edge of the piezoelectric actuator.

4. The speaker of claim 1, wherein the at least one support member is disposed at a central region of the chamber.

5. The speaker of claim 1, wherein the at least one support member comprise multiple support members that are spaced from one another within the chamber.

6. The speaker of claim 5 further comprising an interconnection member coupled between the diaphragm and the piezoelectric actuator, and the interconnection member comprises a H-shaped structure.

7. The speaker of claim 6, wherein the piezoelectric actuator is disposed on a top of each of the multiple support members, and each piezoelectric actuator has an end portion coupled to a recessed portion of the H-shaped structure.

8. The speaker of claim 5, wherein the piezoelectric actuator has end portions attached to the multiple support members respectively.

9. The speaker of claim 8, wherein the multiple support members and the at least one piezoelectric actuator collectively form another chamber.

10. The speaker of claim 1, wherein the piezoelectric actuator comprises a bendable member that is deformed along with the piezoelectric actuator under applied electrical bias.

11. The speaker of claim 1, wherein the piezoelectric actuator comprises an arc-shaped member having a middle portion closer to a bottom of the chamber, the middle portion of the arc-shaped member is secured to a top of the at least one support member and away from the diaphragm, the arc-shaped member further comprises two opposite ends extending beyond two sidewalls of the at least one support member respectively and supporting the diaphragm.

12. A speaker comprising:

a circuit board;

a peripheral wall disposed on a surface of the circuit board;

a diaphragm having an outer boundary attached to the peripheral wall, and the diaphragm, the peripheral wall and the circuit board collectively form a chamber, wherein the diaphragm has at least one suspended edge;

at least one piezoelectric actuator disposed on the surface of the circuit board, and electrically driven to cause a vibration of the diaphragm under applied electrical bias;

a stopper disposed below the diaphragm and spaced from the at least one piezoelectric actuator; and at least one interconnection member coupled between the stopper and the at least one piezoelectric actuator, wherein the interconnection member or the stopper has a peripheral edge that is at least overlapped with the suspended edge of the diaphragm.

13. The speaker of claim 12, wherein the peripheral wall comprises a protrusion disposed within the chamber.

14. The speaker of claim 13, wherein the protrusion of the peripheral wall is at least partially overlapped with the suspended edge of the diaphragm.

15. The speaker of claim 13, wherein the piezoelectric actuator comprises an electrode plate that has an edge at least partially overlapped with the protrusion of the peripheral wall, the protrusion of the peripheral wall is configured to contact the electrode plate to set an upper stop position for the diaphragm when the diaphragm is pushed upwards.

16. The speaker of claim 12, wherein the piezoelectric actuator comprises a bendable electrode plate, the stopper is configured to contact the electrode plate to set a lower stop position for the diaphragm when the diaphragm is pushed downwards.

17. The speaker of claim 12, wherein the piezoelectric actuator comprises a piezoelectric layer, an upper electrode layer and a lower electrode layer, and the piezoelectric layer is sandwiched between the upper and lower electrode layers.

18. The speaker of claim 17, wherein the circuit board has two through holes, and the lower electrode layer is connected to the surface of the circuit board and disposed at a central region of the chamber that is between the two through holes.

* * * * *